United States Patent [19]

Johnson

[11] Patent Number: 4,878,872

[45] Date of Patent: Nov. 7, 1989

[54] ADJUSTABLE ANIMAL APPEARING TOY

[76] Inventor: Cynthia L. Johnson, HCR 61, Box 12, North Amity, Me. 04465

[21] Appl. No.: 241,361

[22] Filed: Sep. 7, 1988

[51] Int. Cl.[4] ..... A63H 3/12; A63H 3/00

[52] U.S. Cl. ..... 446/321; 446/368; 446/387; 446/487

[58] Field of Search ..... 446/368, 490, 269, 324, 446/325, 326, 320, 487, 389, 376, 321, 387, 373; D21/148, 155

[56] References Cited

U.S. PATENT DOCUMENTS

| | | | |
|---|---|---|---|
| 1,796,997 | 3/1931 | Keney | 446/389 |
| 1,918,754 | 7/1933 | Johnson | 446/376 X |
| 2,116,853 | 5/1938 | Stelle | 446/376 |
| 2,751,634 | 6/1956 | Washington | 446/487 |
| 4,578,291 | 3/1986 | Miner | 446/487 X |

FOREIGN PATENT DOCUMENTS

| | | | |
|---|---|---|---|
| 116105 | 6/1918 | United Kingdom | 446/490 |

*Primary Examiner*—Mickey Yu

[57] ABSTRACT

Adjustable animal or creature-appearing toy formed of a number of discs of identical diameter arranged side by side on a common axis. The discs are hinged to each other on an axis offset from the common axis for individual swinging movement of each disc independently of the others. Indicia appear on the exposed side of each endmost disc depicting facial features of a selected animal or creature, the intermediate discs being of different selected colors resembling those of the body of the selected animal. Thereby, when said discs are selectively swung through different predetermined arcs about the offset axis, they suggest to the viewer the body of said animal facing toward or away from the viewer.

4 Claims, 2 Drawing Sheets

ADJUSTABLE ANIMAL APPEARING TOY

This invention relates to children's toys and more particularly to a simple but attractive device which is adjustable to various configurations to resemble various different animals or creatures.

SUMMARY OF THE INVENTION

In accordance with the invention there is provided an adjustable animal or creature-appearing toy comprising a plurality of discs of identical diameter arranged side by side on a common axis. Means are provided hinging the discs to each other on an axis offset from the common axis for individual swinging movement of each disc independently of the others. Indicia appear on the exposed side of each endmost disc depicting facial features of a selected animal or creature, the intermediate discs being of different selected colors resembling those of the body of the selected animal or creature. Thereby, when said discs are selectively swung through different predetermined arcs about the offset axis, they suggest to the viewer the body of said animal or creature facing toward or away from the viewer.

In preferred embodiments, seven intermediate discs are sandwiched between the two endmost discs; the facial depicting indicia suggest a pair of eyes and a nose or mouth, the latter being formed by each end of the hinge means; the intermediate discs are made of relatively stiff paper and the end discs of cloth covered cardboard; the facial features comprise at least a pair of eyes formed by gluing to each end disc superposed oval discs of selected sizes; the hinging means comprises a cord threaded through said discs on the common offset axis and knotted at the ends, the knots being configured to suggest a mouth or nose of the animal or creature.

Still further objects, features and advantages of the invention will become apparent from the following detailed description of a presently preferred embodiment thereof taken in conjunction with the accompanying drawings.

DETAILED DESCRIPTION OF PREFERRED EMBODIMENT

Figure 1:
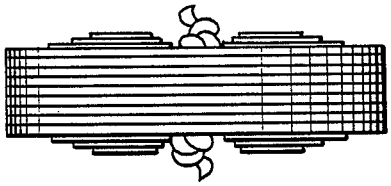
FIG. 1 is an edge view of the novel toy showing the disc arrangement.
Figure 2:
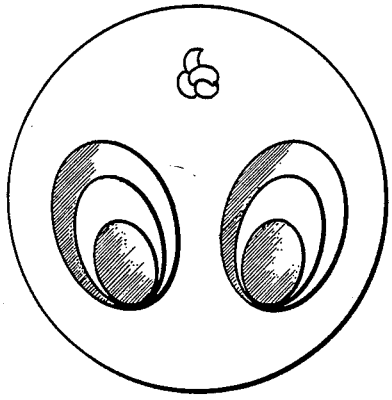
FIG. 2 is a front view of the same.
Figure 3:
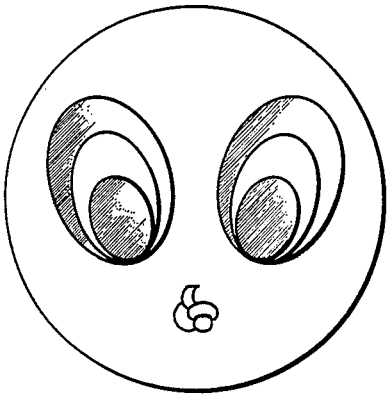
FIG. 3 is a rear view.

First referring to FIGS. 1–3, the novel toy comprises a series of intermediate circular discs 10 sandwiched between a pair of end discs 12A and 12B. The discs may be made of any suitable preferably inexpensive material. The intermediate discs are thinner than the two end discs which must be stiff enough to support the other discs in whatever adjusted positions they may take. I have found that the intermediate discs may be of suitable relatively stiff paper of various colors. Each end disc may be of cardboard sufficiently stiff to hold its shape and to support the intermediate discs. Optionally, the end discs may carry a fabric cover of desired color adapted to support the indicia which are to be affixed thereto.

Each end disc carries on its outward face indicia suggesting the face of a selected animal or creature. In the embodiment shown two eyes 14 are applied to each end disc. The eyes conveniently may comprise superposed oval cloth patches of diminishing size glued to the disc surface and to each other. As shown, the largest patch 16 is affixed to the disc surface to represent the border of the eye. A smaller patch 18 is glued to it to suggest the white of the eye and, finally, a still smaller dark patch 20 is glued to the latter to represent the pupil of the eye.

Figure 4:
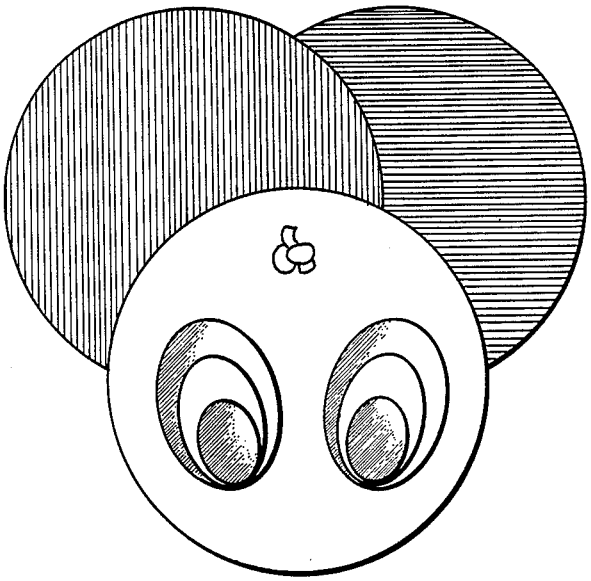
FIG. 4 is a front view showing the appearance of the toy with a pair of intermediate discs swung upwardly partially about the offset axis.
Figure 5:
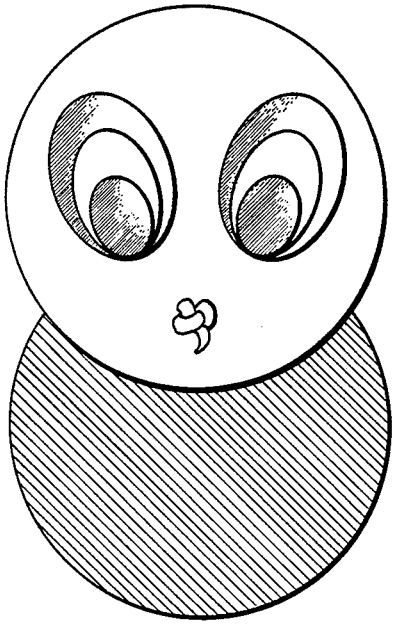
FIG. 5 is a rear view showing the appearance of the toy with one of the intermediate discs swung downwardly.
Figure 6:
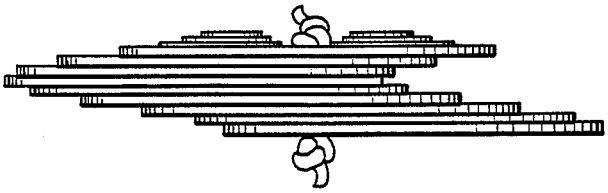
FIGS. 6, 7 and 8 illustrate one of the possible creatures which may be simulated by swinging through preselected arcs the intermediate discs as indicated in FIG. 6, in this case a caterpillar as seen from the front in FIG. 7 and as seen from the rear in FIG. 8.
Figure 7:
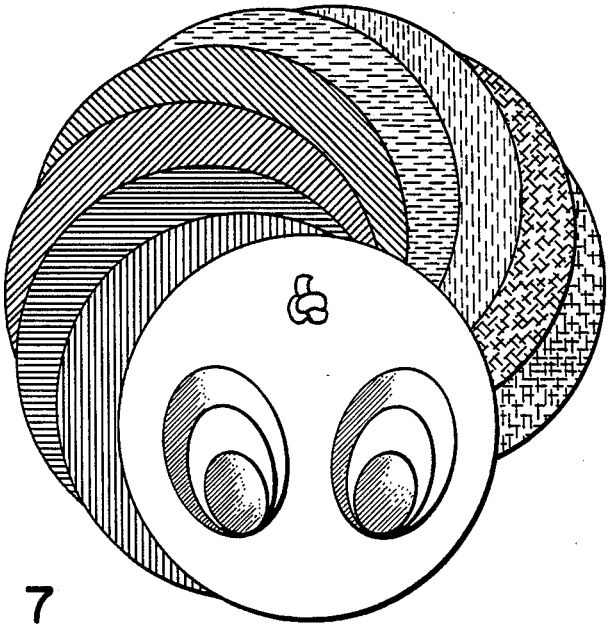
Figure 8:
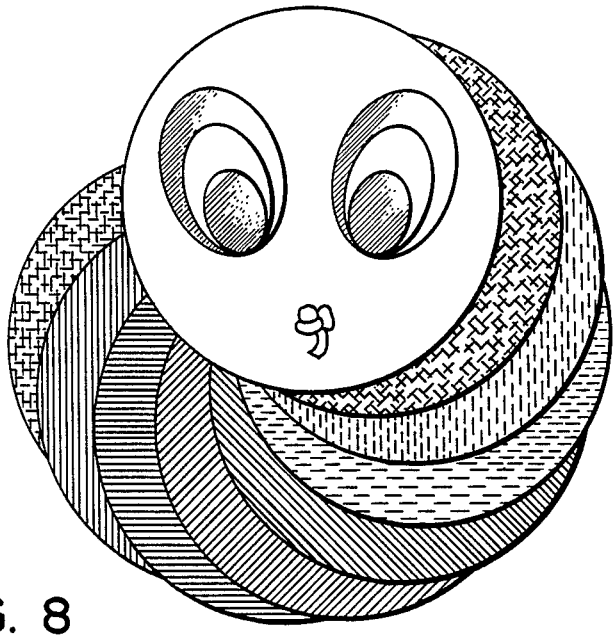

The discs are hinged to swing individually independently of one another about an axis offset from and parallel to the common axis of the discs when they are in registry with one another. The hinge conveniently can comprise a cord 22 knotted at both ends and passing through holes in the common offset axis. The knots can be made faintly to resemble a mouth or nose of the animal or creature. Various possible configurations are shown in the remaining figures. In FIG. 4 two intermediate discs are shown swung partly away from the end discs to suggest ears of an animal. FIG. 5 shows a view with only one intermediate disc swung at 180 degrees from the end discs. FIGS. 6–8 illustrate the toy adjusted to represent a caterpillar, coming and going. Desirably the exposed surfaces of the two end discs are covered with a suitable cloth or fabric of desired texture and color and the simulated eye members glued thereto.

While there has herein been shown and described a presently preferred embodiment of the invention, it will nevertheless be understood that the same is susceptible of modification and change by those skilled in the art and accordingly it is intended that the scope of the invention be limited only by the proper interpretation accorded to the appended claims.

I claim:

1. An adjustable animal or creature-appearing toy comprising a plurality of discs of identical diameter arranged side by side on a common axis, means hinging the discs to each other on an axis offset from said common axis for individual swinging movement of each disc independently of the others, and indicia on the exposed side of each endmost disc depicting facial features of a selected animal or creature, the intermediate discs being of different selected colors resembling those of the selected animal and being composed of relatively stiff material and said end discs being relatively thicker than said intermediate discs and being provided with a textured surface, whereby, when said discs are selectively swung through different predetermined arcs about said offset axis, they suggest to the viewer the body of said animal or creature facing toward or away from the viewer.

2. The toy of claim 1 wherein at least seven intermediate discs are sandwiched between the end discs.

3. The toy of claim 1 wherein the intermediate discs are made of relatively stiff paper and the end discs of cloth covered cardboard.

4. The toy of claim 1 wherein said facial features comprise at least a pair of eyes formed by gluing to each end disc superposed oval discs of selected sizes.

* * * * *